US006891502B2

(12) United States Patent
Harchanko

(10) Patent No.: US 6,891,502 B2
(45) Date of Patent: May 10, 2005

(54) VARIABLE SHAPE ANTENNA ETCHING SYSTEM AND ANTENNA FORMED THEREBY

(75) Inventor: John Harchanko, New Market, AL (US)

(73) Assignee: MEMS Optical, Inc., Hunstville, AL (US)

( * ) Notice: Subject to any disclaimer, the term of this patent is extended or adjusted under 35 U.S.C. 154(b) by 255 days.

(21) Appl. No.: 10/339,493

(22) Filed: Jan. 10, 2003

(65) Prior Publication Data

US 2004/0061658 A1 Apr. 1, 2004

Related U.S. Application Data

(60) Provisional application No. 60/346,616, filed on Jan. 10, 2002.

(51) Int. Cl.[7] ..... H01Q 1/38

(52) U.S. Cl. ..... 343/700 MS; 343/795; 29/600

(58) Field of Search ..... 343/700 MS, 795, 343/793, 757; 29/600; H01Q 1/38

(56) References Cited

U.S. PATENT DOCUMENTS 5,367,308 A * 11/1994 Weber ..... 343/700 MS
6,049,308 A * 4/2000 Hietala et al. ..... 343/700 MS
6,248,487 B1 * 6/2001 Cohn et al. ..... 430/30
6,650,455 B2 * 11/2003 Miles ..... 359/237

* cited by examiner

*Primary Examiner*—Hoanganh Le
(74) *Attorney, Agent, or Firm*—Keady, Olds, Maier & Richardson, PLLC

(57) ABSTRACT

An antenna formation device/method has been developed to create variable shaped antennas using predetermined interference patterns to expose and develop a photoresist layer that is etched on a substrate to form the structure corresponding to the desired variable shaped antenna.

20 Claims, 5 Drawing Sheets

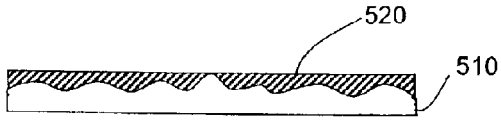
FIGURE 7A
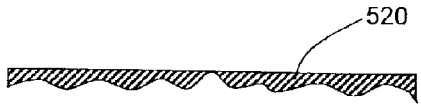
FIGURE 7B
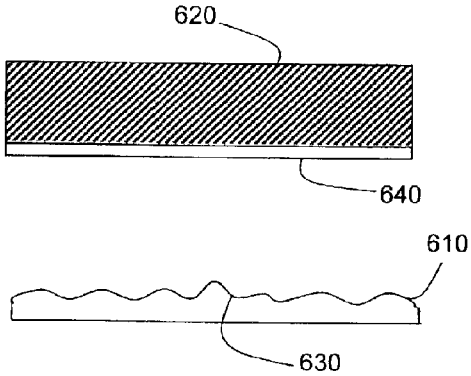
FIGURES 8A
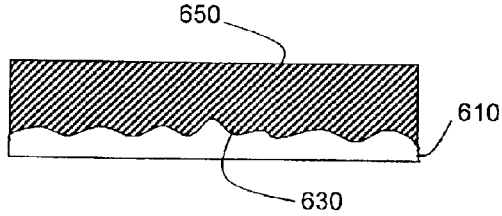
FIGURE 8B
FIGURE 9A
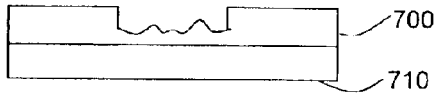
FIGURE 9B
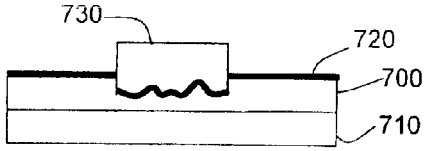
FIGURE 9C
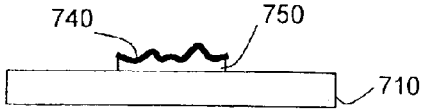

VARIABLE SHAPE ANTENNA ETCHING SYSTEM AND ANTENNA FORMED THEREBY

This application claims the benefit of U.S. Provisional Application No. 60/346,616, filed Jan. 10, 2002.

BACKGROUND OF THE INVENTION

1. Field of the Invention

The present invention relates to a method, apparatus, and system for the fabrication of multi-shaped antennas and to antennae produced thereby. More particularly it relates to the use of multiple light beams to form an interference pattern of various intensities to expose and develop a photoresist material for the formation of optical antennas of various shapes.

2. Background Information

Presently various shapes can be etched into substrate material using grayscale masking techniques. The grayscale mask is used to selectively illuminate a photoresist layer deposited on a substrate, exposing the photoresist layer. The exposed photoresist layer is developed and both the photoresist layer and the substrate are etched forming particular structures. In conventional systems interference patterns are not used to expose the photoresist layer and cut metallic layers typically form antenna systems.

SUMMARY OF THE INVENTION

The present invention is an apparatus/method for forming various shape antennas. One implementation of the present invention has a plurality of light sources, where the light from said sources interfere producing a predetermined interference pattern and a photoresist layer. The photoresist layer is deposited on a substrate, where the interference pattern exposes the photoresist layer. The exposed photoresist layer is developed and used to etch the substrate into a structure corresponding to the interference pattern, and the structure is used to form the antenna.

According to one implementation of the present invention the structure is used as a mold, which is filled with a material that is cured to form the antenna.

Further implementations of the present invention use a lift off process to obtain the antenna. In this implementation the developed photoresist contains a negative relief image of the desired antenna shape. The developed photoresist is coated with a removable layer. A second layer of photoresist is deposited/exposed and developed on the removable layer in a pattern of the desired antenna shape. The second photoresist, the removable layer, and the developed photoresist are etched to form a structure from the removable layer. The structure forms the antenna and is removable from the other layers through chemical processes.

Additional implementations of the present invention contain an interference aid element positioned between a light source and the photoresist layer, where the interference aid element contains openings that act as Huygen sources when illuminated. The emissions from the Huygen sources interfering to form the predetermined interference pattern. The interference pattern exposes the photoresist layer. The exposed photoresist layer is developed and used to etch the substrate into a structure corresponding to the interference pattern, where the structure forms the antenna.

Another implementation of the present invention contains a light source, a multiple beam formation device, an interference device, a photoresist layer and a substrate. Light from the light source illuminates the formation device and the formation device creates multiple beams. The formation device is positioned between the light source and the interference device, where the multiple beams are directed away from the light source and made incident on the interference device. The interference device combines the multiple beams forming a predetermined interference pattern on the photoresist layer, deposited on the substrate. The interference pattern exposes the photoresist layer and the exposed photoresist layer is developed. The developed photoresist layer is used to etch the substrate into a structure corresponding to the interference pattern, where the structure forms the antenna.

A possible antenna according to an implementation of the present invention has a layer of conductive material having a structured surface, where the structured surface is formed by using a mold. Etching a substrate into a predetermined mold shape creates the mold and the mold shape is obtained by using a plurality of light sources to create an interference pattern that exposes a photoresist layer on the substrate. The exposed photoresist layer is developed, and the developed photoresist layer and substrate are etched into the mold shape corresponding to the interference pattern.

A method in accordance with an implementations of the present invention includes depositing a photoresist layer on a substrate; creating a light intensity predetermined interference pattern on the photoresist; exposing the photoresist with the interference pattern; developing the photoresist; etching the photoresist and substrate to form a structure in the substrate corresponding to the interference pattern; and using the structure to form an antenna.

BRIEF DESCRIPTION OF THE DRAWINGS

The present invention will become more fully understood from the detailed description given herein below and the accompanying drawings, which are given by way of illustration only, and thus are not limitative of the present invention, and wherein:

FIGS. 7A and 7B show a filler being used on an etched substrate to form an antenna, the cross section of which is shown in FIG. 7B;

FIGS. 8A and 8B show a stamping process of forming a desired shaped antenna;

FIGS. 9A–C show the use of a first lift-off process to obtain the desired shaped antenna.

DETAILED DESCRIPTION

An antenna of a desire shaped is formed by etching a pattern into a desired surface or substrate. The pattern in accordance with the teachings of the present application is produced through exposure and etching of the surface and photoresist after exposure of the photoresist to form a desired pattern. In accordance with the teachings of the present application, an antenna of a desired shape is produced by exposing the photoresist using an interference pattern. The present invention may use any suitable etching technique such as semi-conductor plasma etching or micro-formation techniques. In embodiments using etching techniques, a photoresist layer is provided on a substrate as is exposed to an illumination interference pattern having the shape of the desired antenna. The variable intensity of the interference pattern exposes the photoresist layer, which is later developed. The developed photoresist is etched along with a substrate into the desired shape.

The shapes of the antennas can be obtained by varying the exposure times, the offset distance, the develop times, the type of photoresist exposed to the light, as well as other processing steps such as bake times and temperatures. The number and wavelength distribution of the sources may also be varied to produce the desired interference pattern. The resultant shape may be the surface of the antenna itself or the surface of a mold which may then be used to mold or stamp the desired antenna contour. The substrate may be conductive itself or may be coated with a desired conductor.

Figure 1:
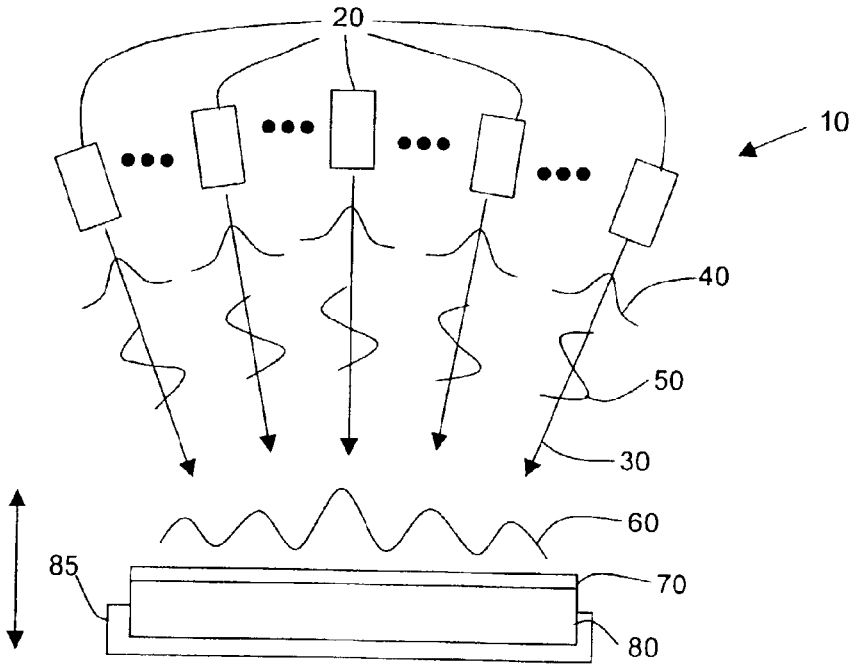
FIG. 1 is a schematic view of an embodiment of a variable shape antenna etching and antenna formation apparatus also illustrating the method of making.

One embodiment (identified generally as 10) of the apparatus for implementing the method of the present application is shown in FIG. 1. In this embodiment a plurality of light sources 20 emit light beams 30. The beams 30 have intensity profiles schematically illustrated as 40 and having wavelengths 50, combine to form an interference pattern 60 of various intensities as is understood by one of ordinary skill. The various intensities of the interference pattern 60 are applied to a photoresist layer 70 provided upon a substrate 80, which is supported by a moveable support 85. The support 85 can move varying the intensity on the photoresist as a function of the movement from a reference position. The resultant intensity patterns are used to expose the photoresist layer 70. The exposed photoresist layer is then developed forming a pattern in the photoresist. This pattern is then used, as is well know, to etch the substrate to transfer the contour or pattern within the photoresist 70 into the substrate 80. Any suitable etching technique may be used to etch the photoresist layer 70 and the substrate 80 leaving a resultant etched pattern in the substrate 80 that is then connected to a suitable source or sensor and acts as a shaped antenna.

The intensities 40 of the light emitted from the various light sources 20 can be the same or may be different as needed to produce the desired antenna profile. Likewise the wavelengths 50 may be the same or different as needed to produce the desired antenna profile, the same wavelengths being called coherent light.

Figure 2:
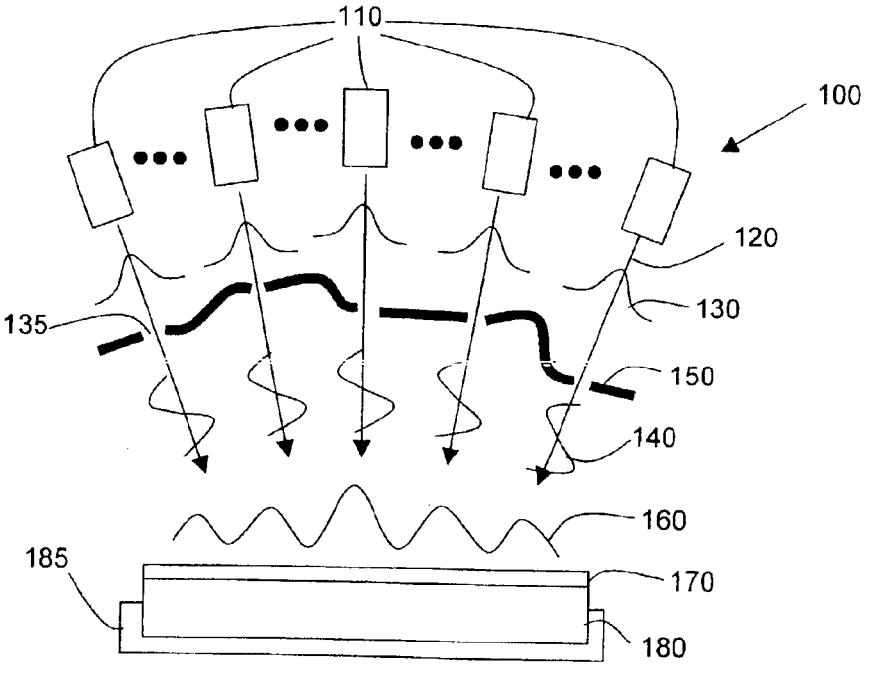
FIG. 2 is a schematic view of a second embodiment of the variable shape antenna etching and antenna formation apparatus having an interference pattern aiding element also illustrating the method of making.

The interference pattern formed is used to expose the photoresist layer 70. The interference pattern can be formed by the interference of direct illumination by a plurality of light sources 20, as shown in FIG. 1, or it can be the result of an interference aid element 150 placed in the path of the light as is illustrated in FIG. 2. The interference aid element 150 can have a predetermined arrangement of openings 135 that act as Huygen Sources. The Huygen sources interfere creating a predetermined pattern in the photoresist. The interference aid element 150 can be of variable shape and non-planar. FIG. 2 illustrates this second embodiment 100 of the method and apparatus used to form antennae according to the present invention where the interference aid element 150 having openings 135 is used to create the desired interference pattern 160 on the photoresist layer 170. The interference aid element 150 is illuminated by a plurality of light sources 110 producing illuminating beams 120 having individual intensities 130 and wavelengths 140.

As described above with respect to FIG. 1 the photoresist layer 170 is deposited on a substrate 180, which is supported by a moveable support 185. The support 185 can move varying the intensity on the photoresist as a function of the movement from a reference position. The photoresist layer 170 is exposed and developed and the substrate 180 etched in the same manner as described above for FIG. 1. As with the other embodiments described herein the material of the substrate 180 will depend on the desired emission and reflective properties of the antenna and whether the etched substrate is to be used as the antenna or as a mold to form the antenna. The material can be typical semiconductor material (e.g. Si, SiN, SiO2, or other similar material) or can be metallic (e.g. Al, Cu, or other similar material). Alternative the substrate may be non-conductive and coated with a conductive antenna coating such as Al, Cu or Ag though a suitable sputtering or vapor deposition process. The discussion herein should not be interpreted to limit the type of material the substrate can be composed of or the antenna formed from as any suitable material may be used.

Figure 3:
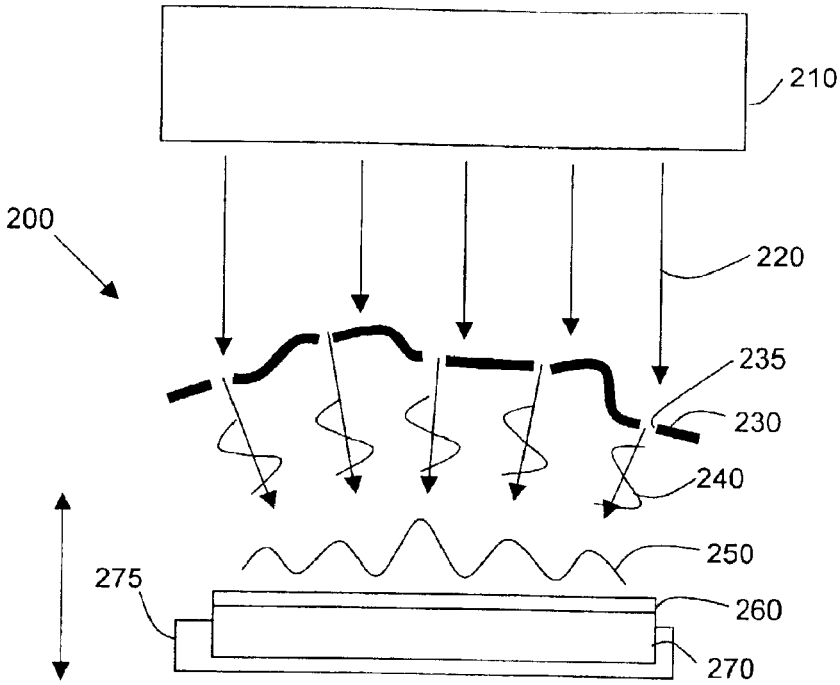
FIG. 3 is a schematic view of a third embodiment of the variable shape antenna etching and antenna formation apparatus having an interference pattern aiding element and a single light source also illustrating the method of making.

FIG. 3 shows an embodiment of the present invention where a single light source 210 is used to produce illumination beams 220 which are supplied to openings 235 in an interference aid element 230. The openings 235 behave as Huygen sources emitting light of wavelengths 240, as described above, to create an interference pattern 250. The interference pattern 250 is used to expose and develop the photoresist layer 260, which is then etched along with the substrate 270, as described above, forming an etched structure in substrate 270, which is supported by a moveable support 275. The support 275 can move varying the intensity on the photoresist as a function of the movement from a reference position.

Figure 4:
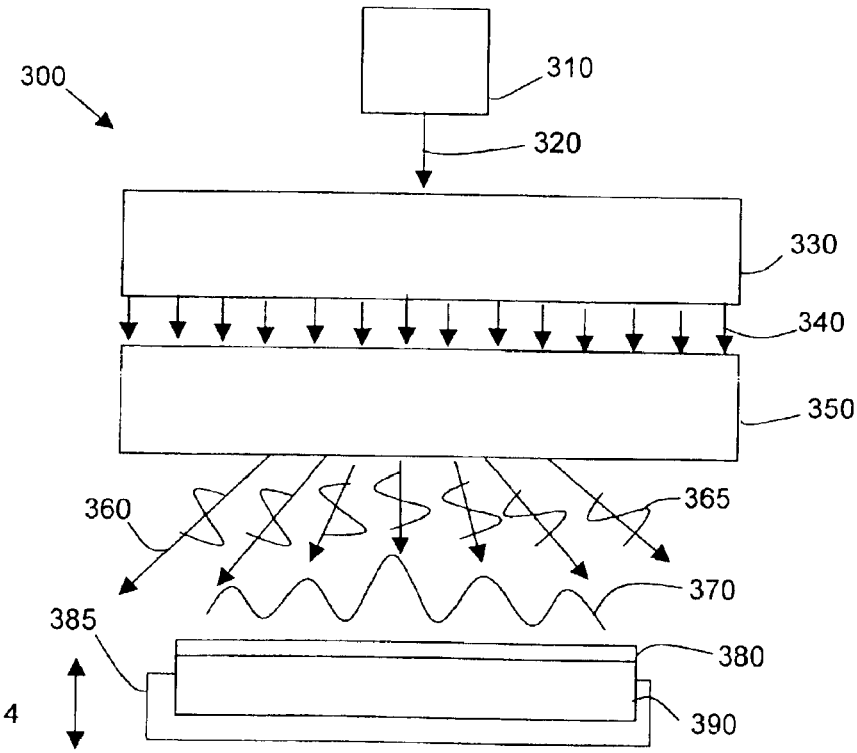
FIG. 4 is a schematic view of a fourth embodiment of the variable shape antenna etching and antenna formation apparatus also illustrating the method of making.

Another embodiment of the invention 300 is shown in FIG. 4. In this embodiment the light 320 from a light source 310 is split into multiple beams 340 by a beam multiplier system 330. The multiple beams 340 pass through an interference device 350, resulting in beams 360, having wavelengths 365 that interfere forming an interference pattern 370. The interference pattern 370 thus created by the interference device 350 is applied to a photoresist 380, provided on a substrate 390, which is supported by a moveable support 385. The support 385 can move varying the intensity on the photoresist as a function of the movement from a reference position. The photoresist 380 is exposed and developed and etched along with the substrate 390 to result in etched structures in the substrate 390. It should be apparent that a negative or positive photoresist 380 may be selected according to the teachings of the present application.

The interference device 350 combines the incident multiple beams into an interference pattern. One embodiment of an appropriate interference device 350 would be a crystal with non-isotropic indices of refraction. The multiple beams would enter such a crystal and be phase shifted upon exiting. The phase-shifted beams interfere when combined, forming an interference pattern.

Another embodiment of an interference device 350 is a lenslet array that redirects beams along different path lengths, where the phase angles are effectively shifted and the beams, upon combination, will form an interference pattern. It is intended that the mechanism of forming an interference pattern from multiple beams is within the contemplation of such an interference device or element 350.

Figure 5:
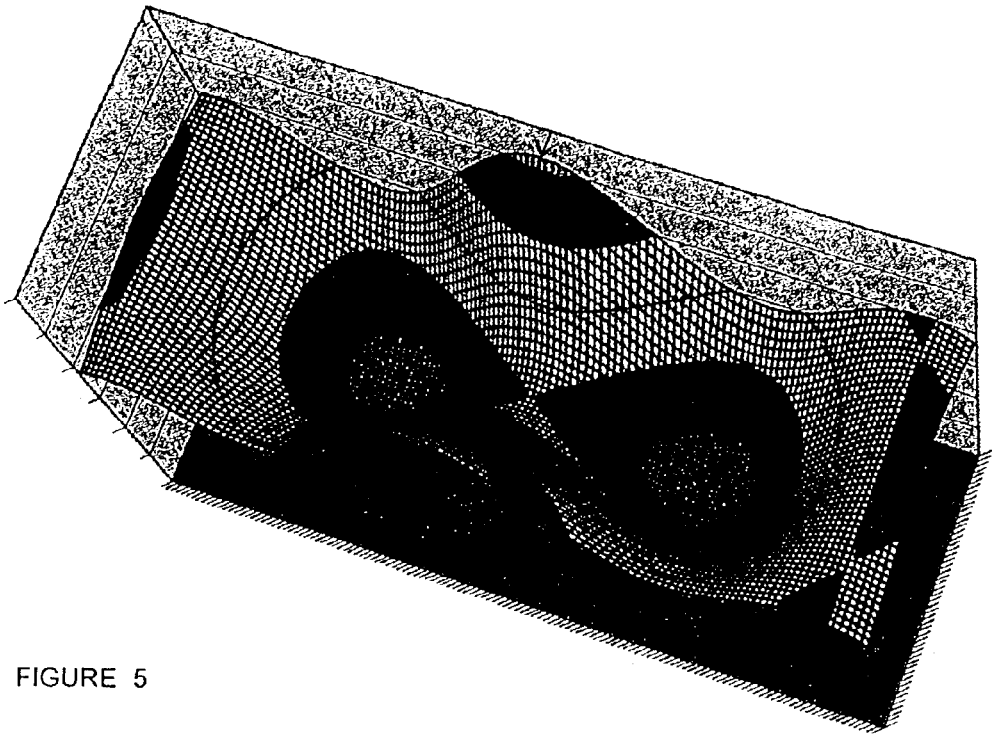
FIG. 5 shows an intensity pattern produced by one exemplary embodiment formed by three light beams, one beam inclined at 15 degrees, one at 0 degrees and the other at −15 degrees.

FIG. 5 shows an exemplary intensity pattern formed by three light beams, one beam inclined at 15 degrees, one at 0 degrees and the other at −15 degrees. The resultant interference intensity pattern, at a predetermined position from the light sources results in a pattern similar to a bow-tie antenna. Such an intensity pattern is used to expose the photoresist. The photoresist is then developed and a desired etching process produces the pattern in the substrate. The substrate may be conductive or semiconductive to produce the antenna surface or may be coated with a conductive or semiconductive coating to produce the antenna surface. substrate.

Figure 6:
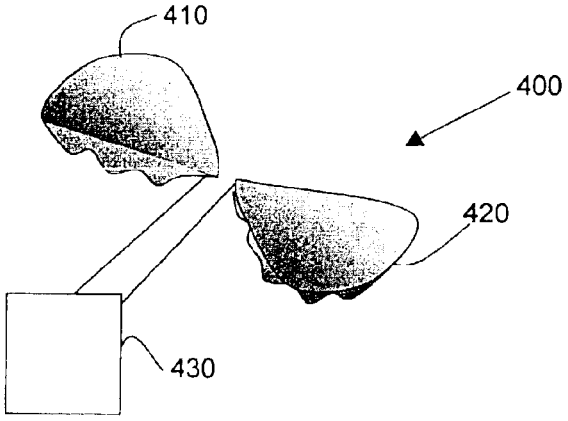
FIG. 6 shows an antenna formed from the intensity pattern of FIG. 5.

FIG. 6 shows an antenna 400 formed in accordance of the methods of the present invention using an intensity pattern similar to that shown in FIG. 5. Two lobes of vary contour form the elements 410 and 420 of the antenna 400. A control device 430 operatively connected to the elements 410 and 420 can vary the current to turn the antenna into an emitter or the control device 430 can be a sensor detecting the current or electric/magnetic field incident on the antenna 400.

The resultant etched structure formed by the methods and apparatuses described above in accordance with the present invention can be used to form various desired antennas. In certain cases (e.g. forming some metallic antennas) a mold can be used where the substrate has been etched forming the desired shape of the antenna and a filler added. Alternatively the mold can be used to mold or stamp the desired shape from a base material. FIGS. 7A and 7B show an embodiment where the antenna 520 is formed from an etched substrate 510 by filling the etched structure with a filling material and removing the filling material, after processing, from the substrate. The filling material can be deposited and cured, deposited and exposed/developed or vapor deposited and then removed.

In another embodiment, shown in FIGS. 8A and 8B, one can use a stamping process to form the desired antenna with the etched structure, where the desired antenna is made of a base material 620 coated with an optional layer 640. The etched substrate 610 has a surface shaped in the desired pattern 630. The substrate 610 can be stamped into the base material 620 forming a stamped base material 650 having the pattern 630 stamped into a surface. Removal of the substrate 610 results in an antenna formed of the stamped base material 650.

In addition to stamping and depositing, a liftoff process can also be used, depending on the type of photoresist, to form the antennas from the described device. For example, with an inverse intensity pattern, an inverse structure pattern (etched instead of raised) will form on the photoresist. The resultant structures in the photoresist can be coated with gold, or other suitable material, for the liftoff process. The raised areas may be cleared of photoresist the lower areas coated with photoresist, and the system etched to provide a pattern for the shapes so that the liftoff process is possible. FIGS. 9A through 9C show a first lift-off process of forming a desired antenna. A patterned photoresist 700 showing an inverse of the desired pattern structure sits atop a substrate 710. The inverse structure is coated with a desired antenna material 720 (e.g. Cu, SiN, or other similar materials) and the patterned portion is coated with an additional developed photoresist 730. Upon etching, the desired antenna 740 and photoresist 750 remain. The photoresist can be removed via chemical lift-off processes so that the antenna 740 remains. The thus, formed antennas, may be of various shapes (e.g. "bow-tie", linear, and any other desired shape).

Figure 10A:
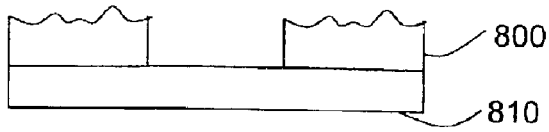
FIGS. 10A–C shows the use of a second lift-off process to obtain the desired shaped antenna.
Figure 10B:
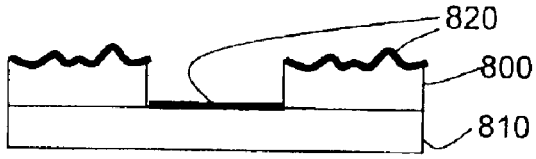
Figure 10C:
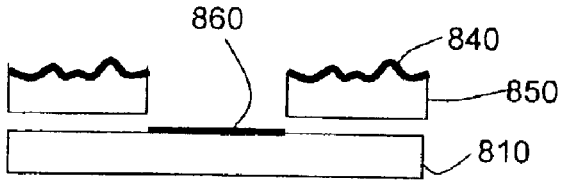

A second lift-off process according to the present invention is shown in FIGS. 10A–C. An exposed and developed photoresist 800, deposited on a substrate 810, has a desired pattern formed by interference patterns. A removal layer 820 (e.g. Ag, Au, and other like materials) is deposited on the developed photoresist. Chemical processes are used to remove the photoresist 850 from the substrate 810 and subsequently from a coating pattern 840, which can be the desired antenna. Alternatively the remaining coating pattern 860 can also be the desired antenna on a substrate backing.

The chemical processes used for the lift-off processes can be a combination of solvent lift-off processes or dry lift-off processes. Solvent lift-off processes (e.g. acetone or other like solvents and chemicals) typical are composed of two steps. The first is an extended immersion of the substrate in organic solvents to soften and dissolve the photoresist. The organic solvent penetrates through microscopic pores in the metal layer and via the exposed edge of the photoresist. Once the photoresist has been softened and dissolved the metal is free to float away from the substrate. A second step consists of spraying the substrate and/or metal with a de-ionized water spray to remove residuals. A dry lift-off process uses a gaseous spray instead of a de-ionized water spray.

Variations in the described device to form etched structures using interference patterns may be realized in accordance with the present invention. It will be obvious to one of ordinary skill in the art are intended to be included within the scope of the following claims.

What is claimed is:

1. An apparatus for forming various shape antennas comprising:

a light source;

a moveable support for receiving a substrate covered by a photoresist layer; and an interference aid element containing openings that act as Huygen sources when illuminated by said light source, the Huygen sources interfering to form a predetermined interference pattern, said interference aid element being positioned between said light source and said support, the interference pattern produced by said interference aid element exposing the photoresist layer enabling patterning of the substrate with a pattern defined by the predetermined interference pattern, the exposed photoresist layer being used to form a structure with a desired antenna contour of the antenna.

2. The apparatus of claim 1, wherein the structure forms a mold, which is filled with a material used to form the antenna.

3. The apparatus of claim 1, wherein the developed photoresist contains a negative relief image of the desired antenna shape, the developed photoresist is coated with a removable layer, a layer of second photoresist being deposited, exposed and developed on the removable layer in a pattern of the desired antenna shape, and the second photoresist, the removable layer, and the developed photoresist are etched to form a structure from the removable layer, where the structure forms the antenna and is removable from the oter layers through chemical processes.

4. The apparatus of claim 1 wherein the interference pattern is changed by moving the support.

5. An apparatus for forming various shape antennas comprising:

a light source;

a multiple beam formation device receiving light from said light source and forming multiple beams therefrom;

a moveable support for receiving a substrate covered by a photoresist layer;

an interference device operatively disposed between said formation device and said support for receiving said multiple beams and directing them to interfere to produce a desired pattern on said photoresist layer when said substance is mounted on said support;

the interference pattern produced by said interference device exposing the photoresist layer enabling patterning of the substrate with a pattern defined by the predetermined interference pattern, the exposed photoresist layer being used to form a structure with a desired antenna contour of the antenna.

6. The apparatus of claim 5, wherein the structure forms a mold, which is filled with a material used to form the antenna.

7. The apparatus of claim 5, wherein the developed photoresist contains a negative relief image of the desired antenna shape, the developed photoresist being coated with a removable layer, a layer of second photoresist is deposited/exposed and developed on the removable layer in a pattern of the desired antenna shape, and the second photoresist, the removable layer, and the developed photoresist are etched to form a structure from the removable layer, where the structure forms the antenna and is removable from the other layers through chemical processes.

8. The apparatus of claim 5 wherein the interference pattern is changed by moving the support.

9. A method for forming various shape antennas comprising:

depositing a photoresist layer on a substrate on a moveable support;

illuminating the photoresist with light intensity from plural sources producing a predetermined interference pattern thereon to expose said photoresist;

developing the photoresist;

etching the photoresist and substrate to form a structure having a contour corresponding to the interference pattern; and using the structure to form an antenna.

10. The method of claim 9, further comprising:

making a mold from said structure; and molding or stamping a material using said mold to form an antenna element; and forming an antenna from said antenna element.

11. The method of claim 10 wherein said antenna element is molded by said step of molding is conductive and is used as an active antenna surface.

12. The method of claim 11 further comprising coating said antenna element with a conductive coating as the active antenna surface.

13. The method of claim 12, wherein the developed photoresist contains a negative relief image of the desired antenna shape, and further comprises:

coating the developed photoresist with a removable layer;

depositing a layer of second photoresist on the removable layer; and exposing and developing the second photoresist in a pattern of the desired antenna shape, where the etching step etches the second photoresist, the removable layer, and the developed photoresist to form a structure from the removable layer, where the structure forms the antenna; and removing the structure from the substrate and photoresist layers through chemical processes.

14. The method of claim 10, wherein the plural sources utilized in said step of illuminating are produced by shining illumination through an interference aid element, where the interference aid element contains openings that act as Huygen sources, the method comprising the additional steps of:

producing said light sources by illuminating the interference aid element with light from at least one light source so that the openings from Huygen sources that interfere forming the predetermined intereferncе pattern.

15. An antenna produced by the method of claim 9.

16. An antenna produced by the method of claim 10.

17. An antenna produced by the method of claim 11.

18. An antenna produced by the method of claim 12.

19. An antenna produced by the method of claim 13.

20. An antenna produced by the method of claim 14.

* * * * *